US010555602B1

(12) United States Patent
Lu

(10) Patent No.: US 10,555,602 B1
(45) Date of Patent: Feb. 11, 2020

(54) HEIGHT-ADJUSTABLE TABLE

(71) Applicant: Dong Guan Song Wei Electric Technology Co., Ltd., Dongguan, Guangdong (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 16/226,632

(22) Filed: Dec. 20, 2018

(51) Int. Cl.
*A47B 9/04* (2006.01)
*A47B 9/20* (2006.01)

(52) U.S. Cl.
CPC ..... *A47B 9/04* (2013.01); *A47B 9/20* (2013.01); *A47B 2009/046* (2013.01); *A47B 2200/0056* (2013.01)

(58) Field of Classification Search
CPC ..... A47B 2009/043; A47B 2009/046; A47B 9/04; A47B 2200/0056; A47B 2200/0057; A47B 2200/0059
USPC ..... 108/147
See application file for complete search history.

(56) References Cited

U.S. PATENT DOCUMENTS 6,595,144 B1 * 7/2003 Doyle ..... A47B 9/00 108/147
9,723,920 B1 * 8/2017 Wu ..... A47B 21/02
2006/0169862 A1 * 8/2006 Liu ..... A47B 9/04 248/422
2008/0178779 A1 * 7/2008 Agee ..... A47B 9/04 108/147
2010/0126393 A1 * 5/2010 Moller ..... A47B 9/04 108/147
2011/0061570 A1 * 3/2011 Klinke ..... A47B 9/20 108/20
2012/0126072 A1 * 5/2012 Pettersson ..... A47B 9/04 248/157
2012/0248910 A1 * 10/2012 Randlov ..... A47B 9/04 310/83
2016/0106205 A1 * 4/2016 Hall ..... A47B 9/00 700/275
2016/0170402 A1 * 6/2016 Lindstrom ..... A47B 9/00 700/275
2016/0345722 A1 * 12/2016 Chen ..... A47B 9/04
2017/0051869 A1 * 2/2017 Hsiao ..... F16M 11/26
2017/0224101 A1 * 8/2017 Bruder ..... A47B 9/04
2017/0303679 A1 * 10/2017 Tseng ..... A47B 9/04
2018/0110324 A1 * 4/2018 Keller ..... A47B 3/08
2018/0172062 A1 * 6/2018 Hu ..... A47B 9/04
2018/0177288 A1 * 6/2018 Lin ..... A47B 9/04
2018/0368569 A1 * 12/2018 Laing ..... A47B 9/00
2019/0025860 A1 * 1/2019 Kollreider ..... A47B 9/04
2019/0059573 A1 * 2/2019 Tseng ..... A47B 9/04

* cited by examiner

*Primary Examiner* — Jose V Chen
(74) *Attorney, Agent, or Firm* — Leong C. Lei

(57) ABSTRACT

A height-adjustable table includes a base, at least two height-adjustable table legs, a retaining frame, a tabletop, a motor box, a controller, a power adapter, and a hand controller. Through the hand controller connected to the controller of the motor box in cooperation with the controller to control the motor, the motor drives the movable inner tube of each table leg to move up and down through the driving rod to achieve the lifting and lowering of the tabletop. The user can adjust the height of the tabletop by simply manipulating the hand controller. The adjustment is more convenient.

9 Claims, 8 Drawing Sheets

HEIGHT-ADJUSTABLE TABLE

BACKGROUND OF THE INVENTION

1. Field of the Invention

The present invention relates to a table, and more particularly to a height-adjustable table.

2. Description of the Prior Art

Tables are widely used in our daily life for eating, working, etc. In general, a table structure mainly includes table legs and a tabletop disposed on the table legs. Most of the tables are placed directly on the ground. The height of the table cannot be adjusted according to the needs of the user. Although there are some tables that can be adjusted in height on the market. Most of tables are adjusted manually. The height adjustment is inconvenient, time-consuming and laborious. The tables have a single function, which cannot meet the needs of use. Therefore, it is necessary to improve the conventional table.

SUMMARY OF THE INVENTION

In view of the drawbacks of the prior art, the primary object of the present invention is to provide a height-adjustable table which can effectively solve the problem that the conventional table is inconvenient for height adjustment and has a single function.

In order to achieve the above object, the present invention adopts the following technical solutions:

A height-adjustable table comprises a base, at least two height-adjustable table legs, a retaining frame, a tabletop, a motor box, a controller, a power adapter, and a hand controller. The table legs are spaced apart and arranged vertically. Each of the table legs includes an immovable outer tube and a movable inner tube. A lower end of the immovable outer tube is fixed to the base. The movable inner tube is movably disposed in the immovable outer tube. An upper end of the movable inner tube extends out of the immovable outer tube. The retaining frame is fixedly connected to the upper end of the movable inner tube of each of the table legs. The tabletop is disposed on top of the retaining frame and fixedly connected to the retaining frame. The motor box is disposed on the retaining frame. The motor box includes a box body and a motor disposed in the box body. The motor drives the movable inner tube of each of the table legs to move up and down through a driving rod. The controller is disposed in the box body. The controller is connected to the motor. The power adapter is connected to the controller. The hand controller is connected to the controller.

Compared with the prior art, the present invention has obvious advantages and beneficial effects. Specifically, it can be known from the above technical solutions:

Through the hand controller connected to the controller of the motor box in cooperation with the controller to control the motor, the motor drives the movable inner tube of each table leg to move up and down through the driving rod to achieve the lifting and lowering of the tabletop. The user can adjust the height of the tabletop by simply manipulating the hand controller. The adjustment is more convenient and saves time and labor. The cost is lower. The structure of the product is simple and stable. The economic value is higher and the functions are diverse, meeting the needs of use.

DETAILED DESCRIPTION OF THE PREFERRED EMBODIMENTS

Figure 1:
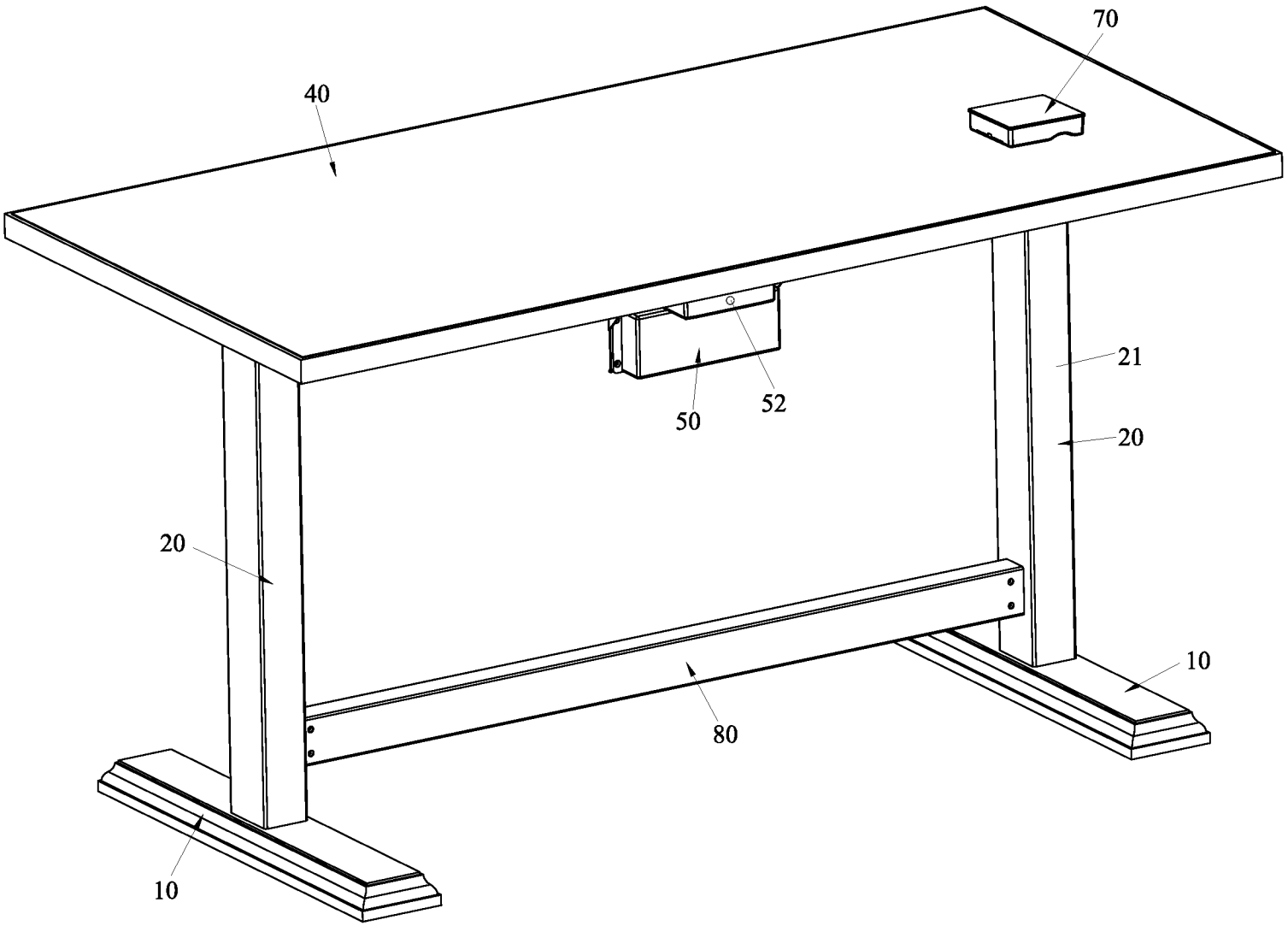
FIG. 1 is a perspective view according to a preferred embodiment of the present invention.
Figure 2:
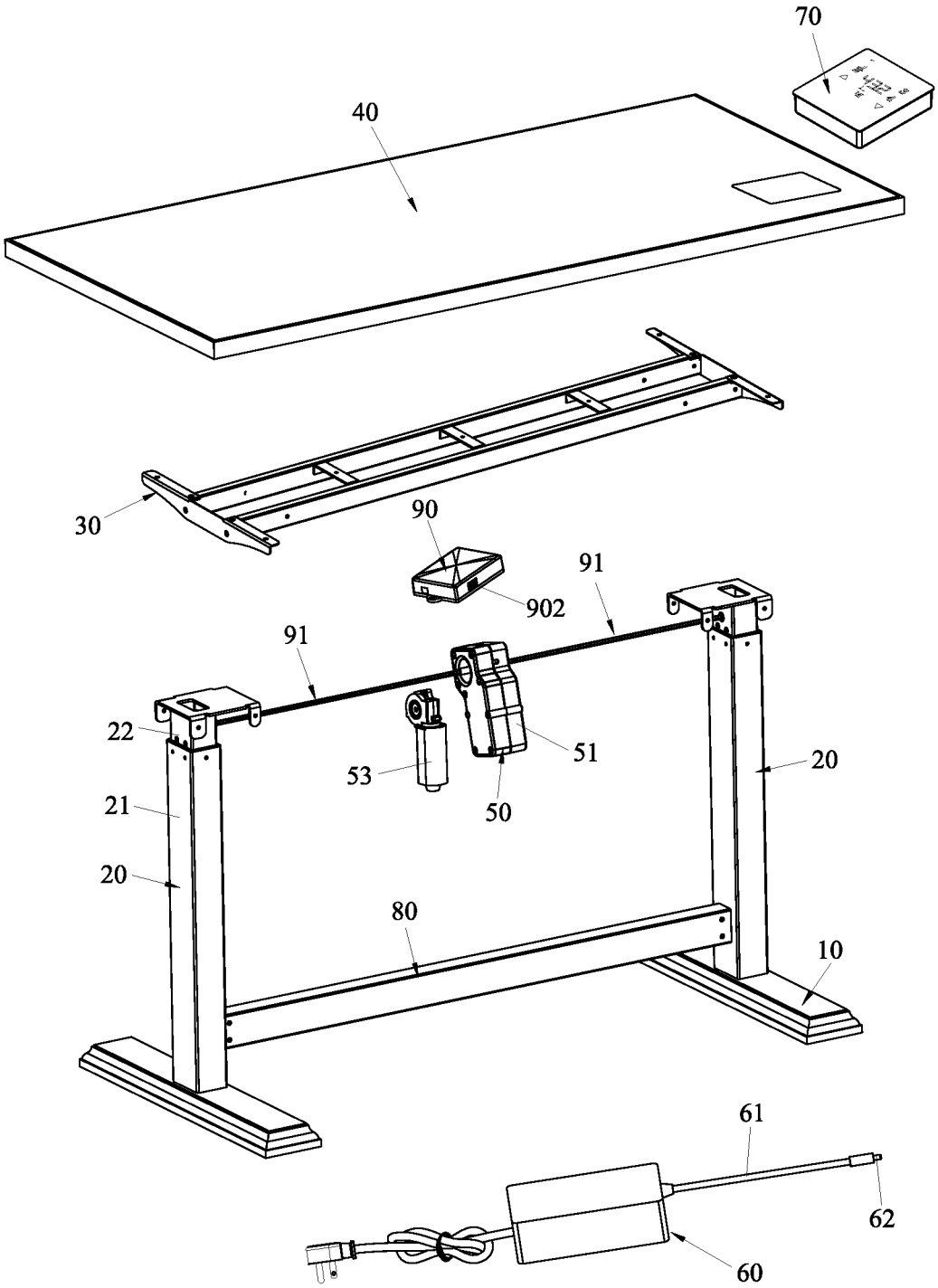
FIG. 2 is an exploded view according to the preferred embodiment of the present invention.

Embodiments of the present invention will now be described, by way of example only, with reference to the accompanying drawings.

Referring to FIG. 1 to FIG. 8, a height-adjustable table in accordance with a preferred embodiment of the present invention comprises a base 10, at least two height-adjustable table legs 20, a retaining frame 30, a tabletop 40, a motor box 50, a controller 90, a power adapter 60, and a hand controller 70.

The table legs 20 are spaced apart and arranged vertically. Each of the table legs 20 includes an immovable outer tube 21 and a movable inner tube 22. A lower end of the immovable outer tube 21 is fixed to the base 10. The movable inner tube 22 can be moved up and down and is disposed in the immovable outer tube 21. An upper end of the movable inner tube 22 extends out of the immovable outer tube 21. In this embodiment, the base 10 includes a left base and a right base corresponding to the two table legs 20. The two table legs 20 are vertically disposed on the left and right bases 10, respectively. A connecting rod 80 is connected between the immovable outer tubes 21 of the two table legs 20.

The retaining frame 30 is fixedly connected to the upper end of the movable inner tube 22 of each of the table legs 20. The tabletop 40 is disposed on top of the retaining frame 30 and fixedly connected to the retaining frame 30.

The motor box 50 is disposed on the retaining frame 30. The motor box 50 includes a box body 51 and a motor 53 disposed in the box body 51. The motor 53 drives the movable inner tube 22 of each table leg 20 to move up and down through a driving rod 91. The controller 90 is disposed in the box body 51. The controller 90 is connected to the motor 53. In the embodiment, the motor box 50 is installed at a middle position of the retaining frame 30. The driving rod 91 is an iron rod having a polygonal cross section. The controller 90 has a USB interface 902 for charging.

The power adapter 60 is connected to the controller 90. The hand controller 70 is connected to the controller 90. In this embodiment, the power adapter 60 may be movable or immovable. An output end of the power adapter 60 is connected with a power cord 61. An output end of the power cord 61 is connected with a connection terminal 62. The connection terminal 62 is connected to a power outlet 52 provided on the motor box 50. The hand controller 70 is connected to the controller 90 through a connection terminal of the motor box 50.

Each of the table legs 20 is provided with an immovable screw rod 92, a movable sleeve 93 and a transmission assembly 94. The immovable screw rod 92 and the movable sleeve 93 are disposed in the movable inner tube 22. A lower end of the immovable screw rod 92 is fixedly connected to the lower end of the immovable outer tube 21. The movable sleeve 93 is screwed to the immovable screw rod 92. An upper end of the movable sleeve 93 is rotatably connected to the upper end of the movable inner tube 22. The transmission assembly 94 is mounted to the upper end of the movable inner tube 22 and drives the movable sleeve 93 to rotate back and forth. The end of the driving rod 91 is connected to the transmission assembly 94. The driving rod 91 drives the transmission assembly 94 to operate.

Figure 3:
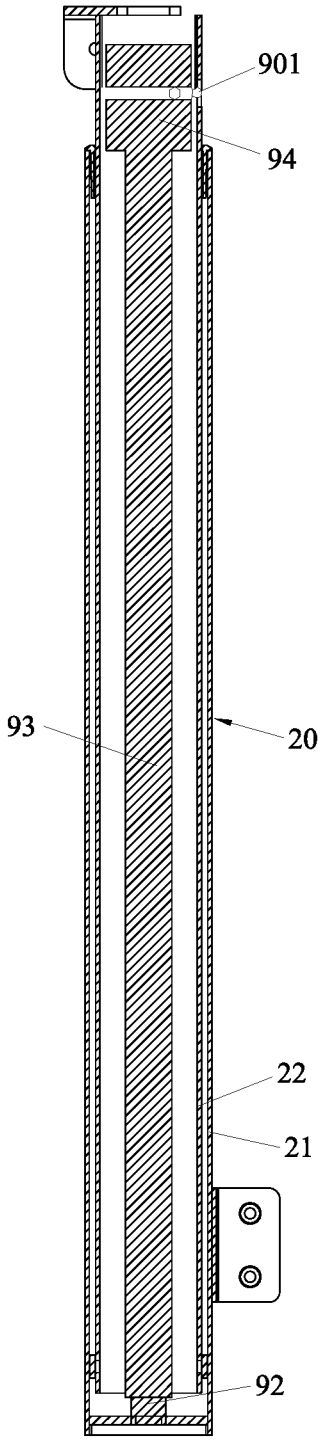
FIG. 3 is a cross-sectional view of the table leg connected with the first type of driving rod according to the preferred embodiment of the present invention.
Figure 4:
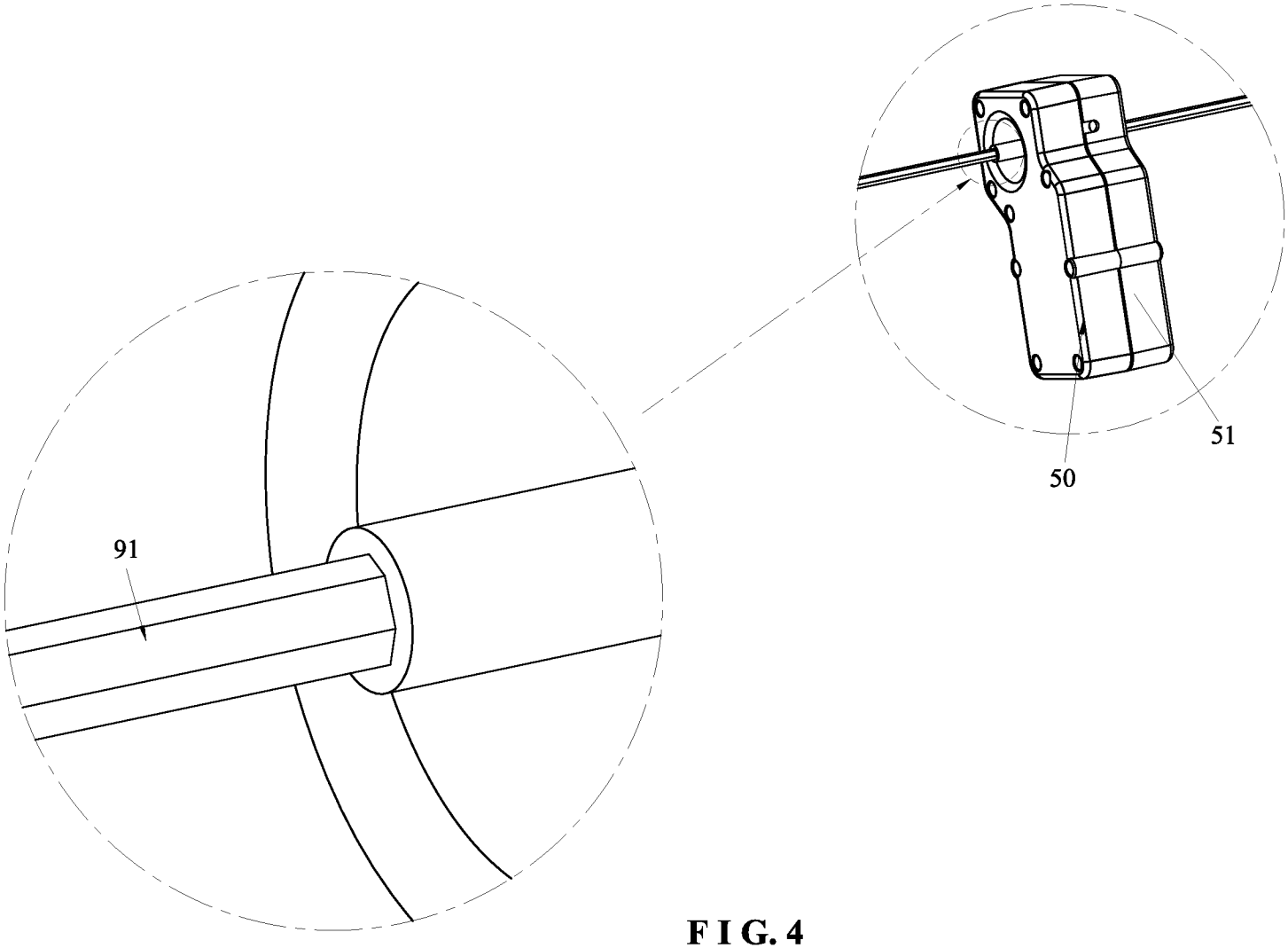
FIG. 4 is a partially enlarged view showing the connection between the first type of driving rod and the motor box according to the preferred embodiment of the present invention.
Figure 5:
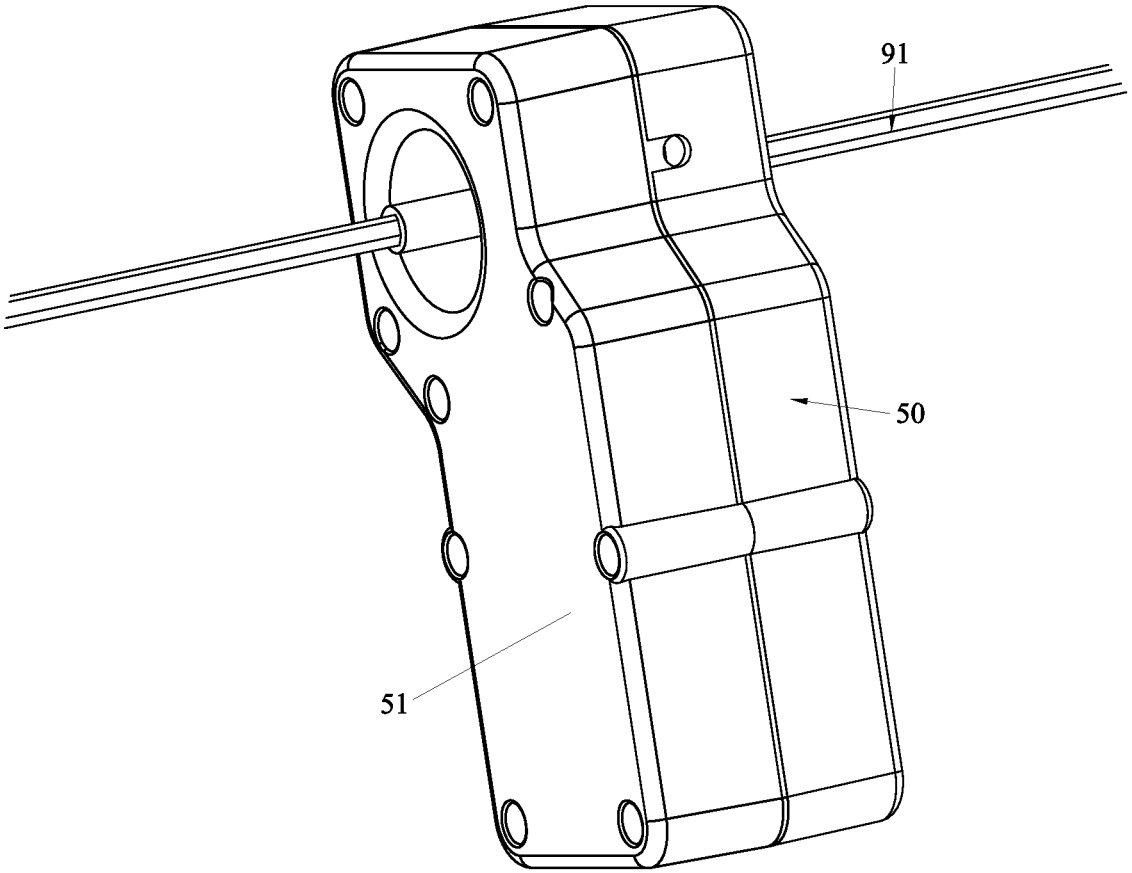
FIG. 5 is an enlarged view showing the connection between the first type of driving rod and the motor box according to the preferred embodiment of the present invention.

As shown in FIG. 3 to FIG. 5, the driving rod 91 may be one. The transmission assembly 94 in each of the table legs 20 has a polygonal opening 901. Two ends of the driving rod 91 extend out of two sides of the motor box 50 and are connected to the corresponding polygonal openings 901 of the transmission assemblies 94 of the table legs 20, respectively.

Figure 6:
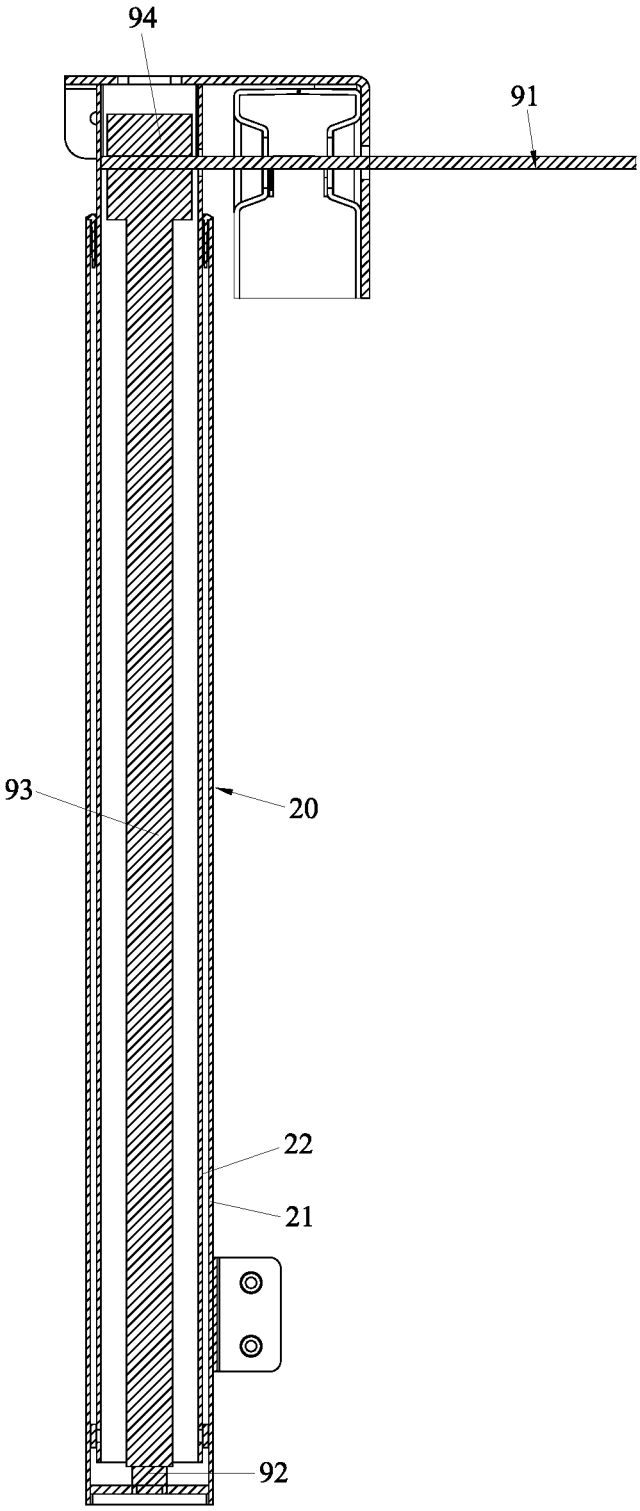
FIG. 6 is a cross-sectional view showing the connection between the second type of driving rod and the table leg according to the preferred embodiment of the present invention.
Figure 7:
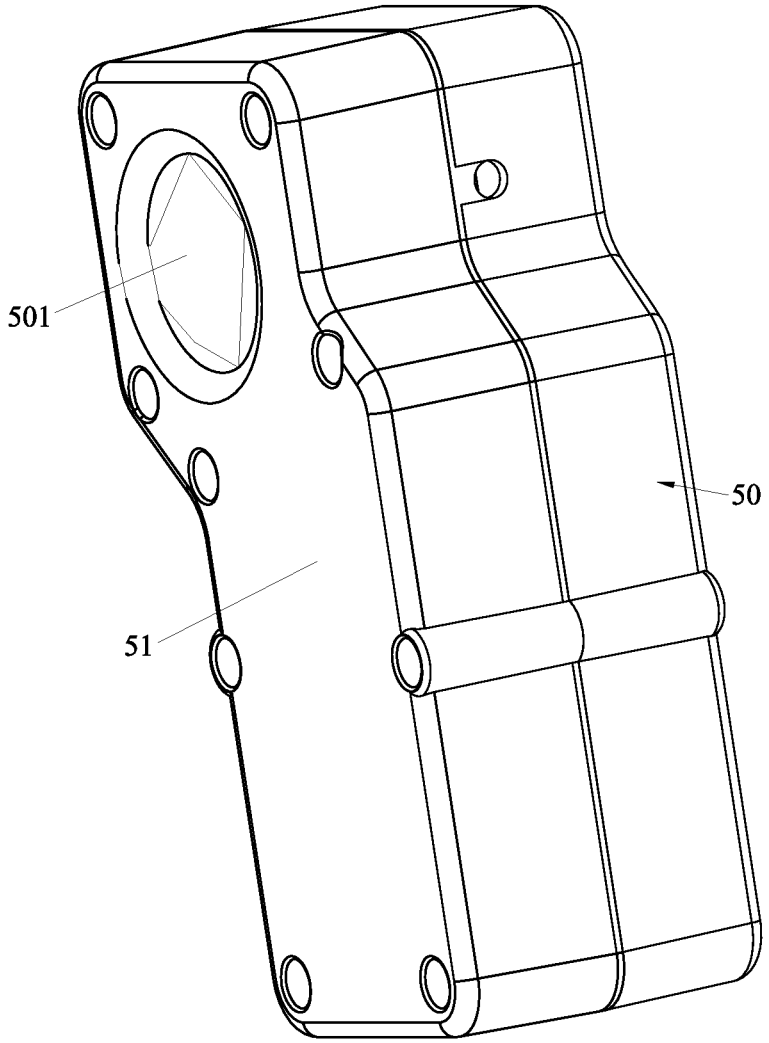
FIG. 7 is an enlarged view showing the motor box corresponding to the second type of driving rod according to the preferred embodiment of the present invention.
Figure 8:
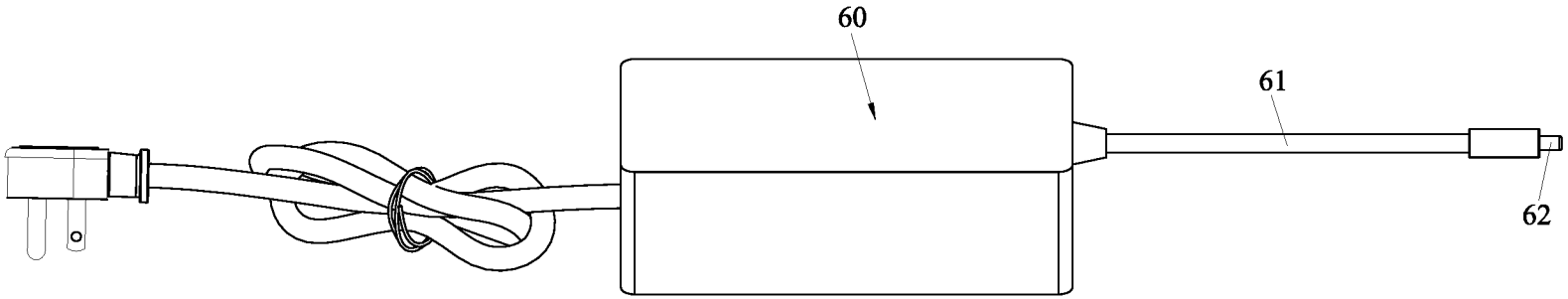
FIG. 8 is an enlarged view showing the power adapter according to the preferred embodiment of the present invention.

As shown in FIG. 6 and FIG. 7, the driving rods 91 may be two. One end of each of the two driving rods 91 is connected to the transmission assembly 94 of the corresponding table leg 20. Two sides of the motor box 50 each have a polygon opening 501. The other end of each of the two driving rods 91 is connected to the corresponding polygonal opening 501.

The working principle of this embodiment is as follows:

In use, the power adapter 60 is connected to the AC power source. When it is necessary to adjust the height of the tabletop 40, the hand controller 70 is manually operated, and the hand controller 70 sends a control signal to the controller 90. The controller 90 controls the operation of the motor 53. The motor 53 drives the transmission assembly 94 in each table leg 20 to rotate through the driving rod 91, so that the corresponding movable sleeve 93 rotates and moves up and down along the corresponding immovable screw rod 92. The movable sleeve 93 moves up and down to drive the retaining frame 30 and the tabletop 40 to move up and down, thereby realizing the lifting and lowering of the tabletop 40.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A height-adjustable table, comprising a base, at least two height-adjustable table legs, a retaining frame, a tabletop, a motor box, a controller, a power adapter, and a hand controller; the table legs being spaced apart and arranged vertically, each of the table legs including an immovable outer tube and a movable inner tube, a lower end of the immovable outer tube being fixed to the base, the movable inner tube being movably disposed in the immovable outer tube, an upper end of the movable inner tube extending out of the immovable outer tube; the retaining frame being fixedly connected to the upper end of the movable inner tube of each of the table legs, the tabletop being disposed on top of the retaining frame and fixedly connected to the retaining frame; the motor box being disposed on the retaining frame, the motor box including a box body and a motor disposed in the box body, the motor driving the movable inner tube of each of the table legs to move up and down through a driving rod; the controller being disposed in the box body, the controller being connected to the motor; the power adapter being connected to the controller; the hand controller being connected to the controller, wherein each of the table legs is provided with an immovable screw rod, a movable sleeve and a transmission assembly, the immovable screw rod and the movable sleeve are disposed in the movable inner tube, a lower end of the immovable screw rod is fixedly connected to the lower end of the immovable outer tube, the movable sleeve is screwed to the immovable screw rod, an upper end of the movable sleeve is rotatably connected to the upper end of the movable inner tube, the transmission assembly is mounted to the upper end of the movable inner tube and drives the movable sleeve to rotate back and forth, and an end of the driving rod is connected to the transmission assembly.

2. The height-adjustable table as claimed in claim 1, wherein the base includes a left base and a right base corresponding to the two table legs, the two table legs are vertically disposed on the left and right bases respectively, and a connecting rod is connected between the immovable outer tubes of the two table legs.

3. The height-adjustable table as claimed in claim 1, wherein the driving rod has a polygonal cross section, the driving rod includes two driving rods, one end of each of the two driving rods is connected to the transmission assembly of a corresponding one of the table legs, two sides of the motor box each have a polygon opening, and another end of each of the two driving rods is connected to the corresponding polygonal opening.

4. The height-adjustable table as claimed in claim 1, wherein the driving rod has a polygonal cross section, the transmission assembly in each of the table legs has a polygonal opening, and two ends of the driving rod extend out of two sides of the motor box and are connected to the corresponding polygonal openings of the transmission assemblies of the table legs, respectively.

5. The height-adjustable table as claimed in claim 1, wherein the motor box is installed at a middle position of the retaining frame.

6. The height-adjustable table as claimed in claim 1, wherein the power adapter is movable or immovable, an output end of the power adapter is connected with a power cord, an output end of the power cord is connected with a connection terminal, and the connection terminal is connected to a power outlet provided on the motor box.

7. The height-adjustable table as claimed in claim 1, wherein the hand controller is connected to the controller through a connection terminal of the motor box.

8. The height-adjustable table as claimed in claim 1, wherein the controller has a USB interface for charging.

9. The height-adjustable table as claimed in claim 1, wherein the driving rod is an iron rod having a polygonal cross section.

* * * * *